US007028627B2

(12) United States Patent
Bouchaud et al.

(10) Patent No.: US 7,028,627 B2
(45) Date of Patent: Apr. 18, 2006

(54) SUBMERSIBLE VEHICLE LAUNCH AND RECOVERY SYSTEM

(75) Inventors: David Laurent Claude Bouchaud, Hyeres (FR); Pierre-Yves Eugene Jean Le Bigot, Sanary S/Mer (FR)

(73) Assignee: ECA, La Garde (FR)

( * ) Notice: Subject to any disclaimer, the term of this patent is extended or adjusted under 35 U.S.C. 154(b) by 0 days.

(21) Appl. No.: 11/089,534

(22) Filed: Mar. 24, 2005

(65) Prior Publication Data

US 2005/0257731 A1 Nov. 24, 2005

(30) Foreign Application Priority Data

Mar. 24, 2004 (FR) ..... 04 03017

(51) Int. Cl.
*B63C 7/00* (2006.01)

(52) U.S. Cl. ..... 114/51; 114/259; 294/82.27

(58) Field of Classification Search ..... 114/50, 114/51, 259, 313, 322, 365, 370; 294/82.27, 294/82.32

See application file for complete search history.

(56) References Cited

U.S. PATENT DOCUMENTS 1,273,650 A * 7/1918 Nelles ..... 294/82.27
1,507,706 A 9/1924 Miller et al. ..... 294/82.32
1,770,343 A * 7/1930 Reichmann ..... 114/51
3,853,082 A * 12/1974 Rosenberg et al. ..... 114/51
4,271,553 A 6/1981 Korsvik ..... 114/373
5,253,606 A * 10/1993 Ortelli ..... 114/259
6,257,636 B1 * 7/2001 Hovis et al. ..... 294/82.32
6,698,376 B1 3/2004 Delahousse et al. ..... 114/322

FOREIGN PATENT DOCUMENTS

FR 2 823 485 10/2002
GB 26192 11/1914

OTHER PUBLICATIONS

Institut National de la Propriete Industrielle "Rapport De Rechereche Preliminaire," mailed Oct. 11, 2004; 2 pages.

* cited by examiner

*Primary Examiner*—Lars A. Olson
(74) *Attorney, Agent, or Firm*—Meyertons, Hood, Kivlin, Kowert & Goetzel, P.C.; Eric B. Meyertons

(57) ABSTRACT

A submersible vehicle launch and recovery system comprises a grab comprising at least two arms capable of moving relative to each other, the arms being rotatable between an open position and a closed position, in which closed position the jaws of the arms are able to grip a handling feature on a submersible vehicle. The arms comprise attachment means so arranged that the arms tend to close when the system is suspended by the said attachment means, at least one arm comprising buoyancy means so distributed as to tend to open the said arm when the system is submerged.

12 Claims, 2 Drawing Sheets

SUBMERSIBLE VEHICLE LAUNCH AND RECOVERY SYSTEM

BACKGROUND OF THE INVENTION

1. Field of the Invention

The present invention relates to the handling of underwater machines, and in particular to a submersible vehicle launch and recovery system.

2. Description of the Relevant Art

Systems for launching and recovering submersible vehicles come in the form of a cage that can be open or closed to release or recover the submersible vehicle. Document FR 2 823 485 discloses a system having an upper frame and lower frame forming a cage, the frames being moveable vertically relative to each other to either secure the submersible vehicle or release it.

However, such launch and recovery systems are unsuitable for some types of submersible vehicle, particularly submersible vehicles with fragile external equipment on an outer surface of the vehicle, such as propulsion units or measuring instruments. In this case there is a risk of damage to this equipment.

SUMMARY OF THE INVENTION

It is desirable to provide a submersible vehicle launch and recovery system suitable for handling submersible vehicles that have fragile external equipment, and that is simple to use.

A submersible vehicle launch and recovery system in one embodiment, includes a grab including at least two arms capable of moving relative to each other, the arms being rotatable between an open position and a closed position, in which closed position the jaws of the arms are able to grip a handling element on a submersible vehicle, the arms including attachment means so arranged that the arms tend to close when the system is suspended by the attachment means, at least one arm including buoyancy means so configured as to tend to open the arm when the system is submerged.

The system in the form of a grab may be used to easily pick up a handling feature projecting from a submersible vehicle without the risk of bumping into equipment on the outside of the vehicle. Once the submersible vehicle-handling element is correctly positioned relative to the jaws, the simple act of raising the arms will cause the said jaws to close on the handling feature, so that the submersible vehicle may easily be gripped by the launch and recovery system. Moreover, provided the buoyancy means are appropriately distributed, the jaws of the arms will open spontaneously during submersible vehicle launch when the vehicle is lowered into the water, at the point when the buoyancy means are partly or completely submerged.

In one embodiment the arms are arranged in a cross and connected rotatably about a hinge pin at the intersection of the arms. Each arm may include, at a first end situated on one side of the hinge pin, a jaw and a buoyancy means, and, at a second end situated on the other side, arm attachment means.

In one embodiment a buoyancy means is provided in the form of a hollow float equipped with fluid filling and evacuation means, the fluid being air and/or water in particular. This makes it easy to control the buoyancy of the buoyancy means in order to open the arms of the launch and recovery system at the desired depth.

In one embodiment the arms are provided with guide means for acting on a handling feature provided on a submersible vehicle. The guide means are designed to guide the movements of the submersible vehicle in order to position the handling feature between the jaws of the movable arms in order to get the submersible vehicle in position for recovery.

In one embodiment the guide means include a V guide converging on a space situated between the jaws of the arms. In this way the submersible vehicle may be advanced between the jaws, guided by the V guide.

In one embodiment the guide means include at least one end stop located on an arm and designed to horizontally arrest a handling feature situated on a submersible vehicle. The submersible vehicle can thus be advanced in such a way as to position the handling feature between the jaws. The end stops will define the longitudinal position of the handling feature between the jaws before the arms can be closed and the submersible vehicle recovered.

In one embodiment the end stops are provided with protuberances arranged so as to prevent a reverse movement of a handling element once the latter is engaged against the end stops.

In one embodiment the system includes means for limiting the opening of the grab formed by the arms. Such means may be provided in the form of a flexible or rigid element attached at one end to one arm and at the other end to the other arm to prevent the separation between the arms increasing beyond a predetermined limit.

Also described herein is an assembly including a launch and recovery system and a handling feature designed to be attached to a submersible vehicle and configured so as to engage with the jaws of the launch and recovery system.

In one implementation, a handling feature includes a T-shaped profile having a web designed to be gripped by the jaws and a transverse bar for vertical support. Other forms are possible.

BRIEF DESCRIPTION OF THE DRAWINGS

The present invention and its advantages will be understood more clearly on examining the detailed description of an embodiment taken as an example, without in any way implying any limitation, and illustrated in the appended drawings, in which.

Figure 1:
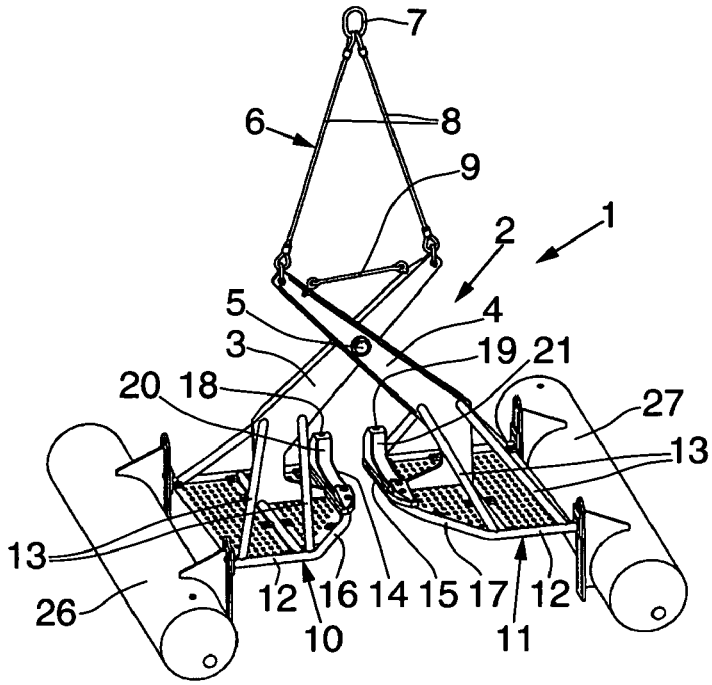
FIG. 1 is a perspective view of a submersible vehicle launch and recovery system.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

In FIG. 1 the launch and recovery system 1 includes a grab 2 formed by two arms 3, 4 arranged in a cross and coupled together by a hinge pin 5 at the intersection between the arms 3, 4. Top ends of the arms 3, 4 have means of attachment, here in the form of rings passed through holes in the ends of the arms 3, 4. A lifting sling 6 comprises a main ring 7 and two lines 8, each line being coupled at one end to the main ring 7 and at the other to the arm 3, 4 attachment means.

The system 1 includes an opening limiter that takes the form of a link 9 whose ends are attached to the top ends of the arms 3, 4 in such a way that the link 9 inhibits separation of the top ends of the arms 3, 4 and thus limits the opening of the arms 3, 4. The link 9 may for example be a metal rod, a sling, a chain or a cord.

The lower ends of the arms 3, 4 have a C-shaped profile so that each bends towards the other arm at the bottom. Frames 10, 11 are attached to the lower ends of the arms 3, 4, respectively. Each frame 10, 11 has a generally flat tubular perimeter 12 and reinforcing tubes 13 extend between the perimeter 12 and an intermediate portion of the arms 3, 4. On the mutually facing sides of the perimeters 12 are jaws 14, 15 designed to come together when the arms 3, 4 are closed. The perimeters 12 include oblique tube portions 16, 17 opposite each other, and these continue on from the jaws 14, 15 towards the rear. The tube portions 16, 17 form a V guide that converges on the space lying between the jaws 14, 15.

The frames 10, 11 have end stops 18, 19 mounted on the frames 10, 11 above the jaws 14, 15. The end stops 18, 19 have upper surfaces 20, 21.

Figure 2:
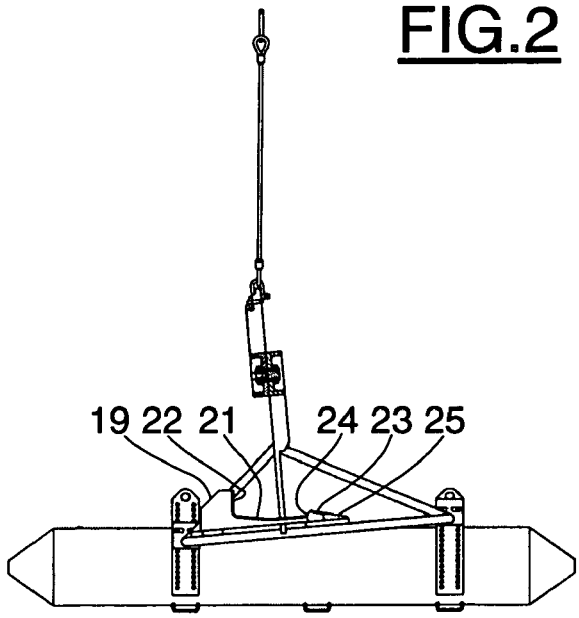
FIG. 2 is a side view of the system shown in FIG. 1.

As can be seen more clearly in FIG. 2, an end stop 19 has a first surface 21 that terminates at the forward end, away from the V guide, in an approximately vertical abutment surface 22. At the other end, towards the V guide, the end stop 19 includes a non-return protuberance 23 presenting towards the abutment surface 22 a low abutment wall 24 that is not as high as the abutment surface 22, and presenting in the other direction an inclined surface 25.

Returning to FIG. 1, on the outwards side of the frames 10, 11 away from the jaws 14, 15, are cylindrical floats 26, 27 at a lateral distance from the hinge pin 5 of the arms 3, 4.

Figure 3:
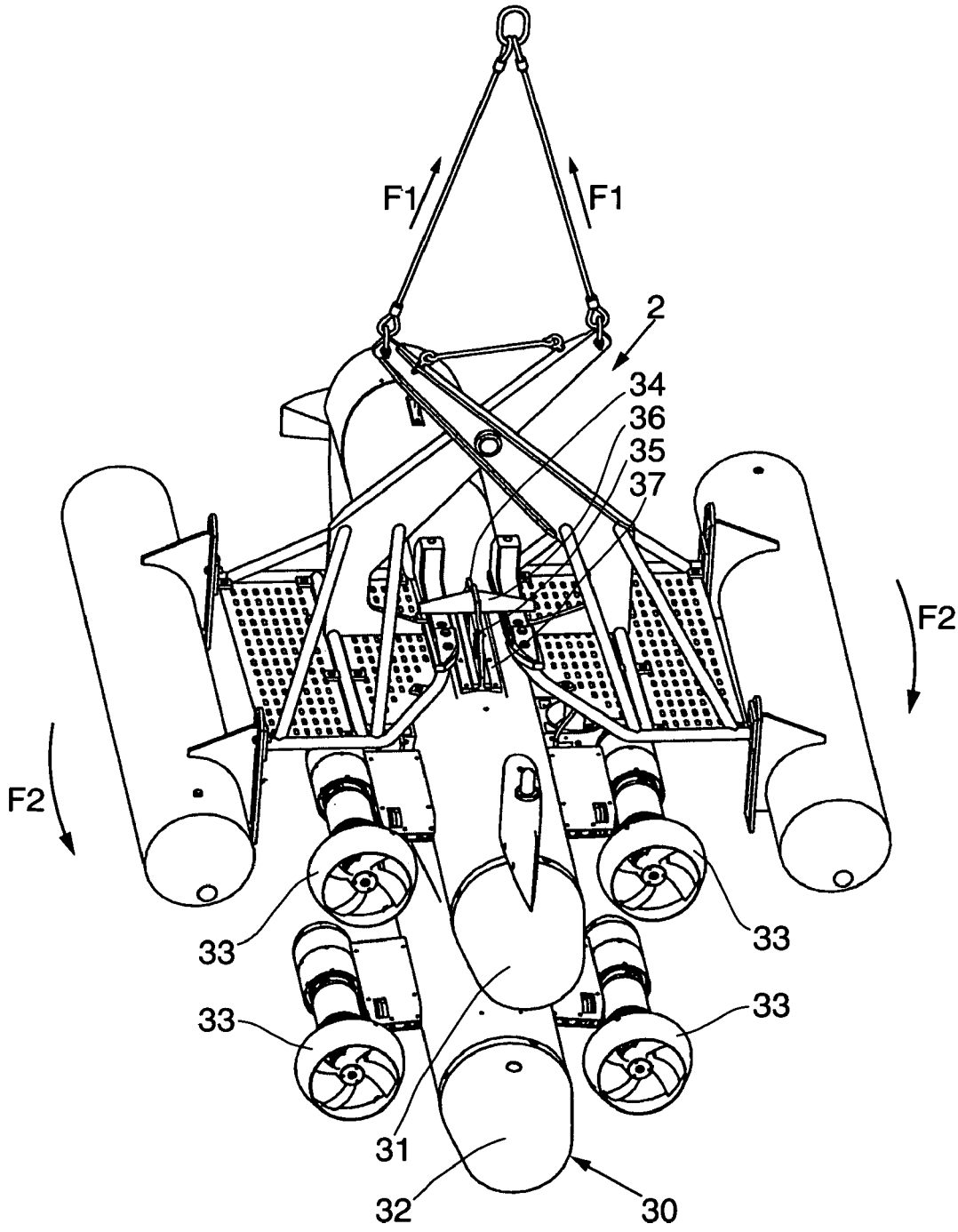
FIG. 3 is a perspective view of the launch and recovery system shown in FIG. 1 and of a submersible vehicle positioned where it can be recovered by the system.

In FIG. 3, a submersible vehicle 30 includes a main body that includes two superposed and parallel tubular parts 31, 32, and propulsion means in the form of propulsion units 33, of which there are four in the present case, arranged on either side of each of the tubular parts.

The submersible vehicle 30 is equipped with a handling feature 34 attached to the top of the vehicle. The handling feature 34 forms a T in profile and comprises a flat longitudinal web 35 extending upwards from the vehicle surface and supporting at its upper end a transverse bar 36 perpendicular to the web 35. The web 35 has an enlarged base 37 with means for attaching it to the shell of the submersible vehicle 30, such as drillings for bolts.

In the form shown in FIG. 3, the submersible vehicle 30 positions itself beneath the grab 2 in such a way that the handling feature 34 is positioned between the jaws 14, 15 (FIG. 2) of the grab 2. The transverse bar 36 positions itself above the jaws 14, 15, more precisely above the surfaces 20, 21, (FIG. 2) of the end stops 18, 19 (FIG. 2).

The operation of the submersible vehicle launch and recovery system is described below.

During recovery, the submersible vehicle 30 is initially positioned in the water. The system 1 is placed in the water a matter of some meters away from the submersible vehicle. The floats 26, 27, being held up by their buoyancy, cause the jaws 14, 15 to open spontaneously as far as the limiter 9 will allow. The vehicle 30 is then remotely driven by an operator at low speed until the handling feature 34 is between the jaws 14, 15 of the system 1. The limiter 9 is adjusted so that the maximum separation between the jaws 14, 15 is less than the length of the transverse bar 36 of the handling feature 34. The handling feature 34 cannot be moved vertically between the open jaws 14, 15 without the transverse bar 36 being stopped by the jaws 14, 15.

The submersible vehicle 30 is manoeuvred to insert the handling feature 34 horizontally between the jaws 14, 15 from the rear, that is from the V guide side, and in such a way that the shell of the vehicle 30 passes underneath the frames 10, 11 while the transverse bar 36 of the handling feature 34 passes above them. Vertical propulsion units on the vehicle may be used for this purpose to present the handling feature 34 at the correct height.

There is a sufficient gap between the transverse bar 36 of the handling feature 34 and the shell of the submersible vehicle 30 to allow the transverse bar 36 to pass over the protuberances 23 under these circumstances. By contrast, the abutment surfaces 22 of the end stops 18, 19 are tall enough to prevent the transverse bar 36 passing over them.

In the event of poor lateral alignment, the handling feature 34 comes into contact with the edges of the V guide, thus realigning the handling feature 34.

When the handling feature 34 is between the jaws 14, 15, vertical propulsion units on the vehicle can be used to lower the vehicle and hence lower the transverse bar 36 onto the end stops 18, 19. In all cases the sling 6 is then tensioned by applying an upward vertical force on the main ring 7, helping to press the transverse bar 36 firmly onto the tops of the end stops 18, 19. The two lines 8 of the sling 6 also exert an upward force on the top ends of the arms 3, 4 as illustrated by the arrows F1 which tends to pivot the arms 3, 4 relative to each other about the pin 5 in such a way that jaws 14, 15 move towards each other as shown by the arrows F2. When the sling 6 is sufficiently taut, the jaws 14, 15 close and grip the web 35, ensuring that the submersible vehicle 30 is held firmly.

A forward movement of the vehicle relative to the grab is inhibited by the abutment surfaces of the end stops 18, 19. Also, because the transverse bar 36 of the handling feature 34 is resting vertically on the top surfaces of the end stops 18, 19, the abutting walls 24 of the protuberances 23 now inhibit any rearward movement of the handling feature 34 and therefore of the submersible vehicle 30. The vehicle 30 is held in place longitudinally between the jaws 14, 15.

To facilitate closure of the grab 2, the floats can be weighted to reduce their buoyancy and so reduce jaw-opening forces. For this purpose, arrangements may be made to fill the floats 26, 27, for example with water, when the handling feature 34 is between the jaws 14, 15, while the latter are still open or once they are closed.

Once the system is out of the water, the weight of the floats 26, 27 exerts a downward load on the ends of the arms 3, 4, helping to close the grab 2, and consequently helping to hold the vehicle 30 firmly between the jaws 14, 15.

In a variant, automatic guidance of the submersible vehicle 30 may be provided. For this purpose the system may be equipped with transmitting or receiving beacons which cooperate with corresponding beacons on the submersible vehicle to give the submersible vehicle 30 indications as to the relative positions of the system 1 and the submersible vehicle 30. This information can be used by means of automatic control of the vehicle 30.

If the vehicle is being positioned by remote control by an operator, a video camera may be installed on the system 1, for example on the hinge pin 5 of the arms 3, 4 to observe the approach of the submersible vehicle 30.

For recovery operations, the system, installed on a ship, can be launched when the ship is either stationary or moving. In this case, recovery can be performed with the ship moving, the device being towed behind the ship or alongside.

For launching the submersible vehicle 30, the vehicle is picked up from a storage platform by the launch and recovery system 1. The tension of the sling 6 and the weight of the floats 26, 27 help to keep the grab 2 closed. The system is lowered into the water. When the floats 26, 27 of the system 1 are in the water they experience an upward floating force, causing the arms 3, 4 to open. As long as the closing force applied by the sling 6 is greater than the opening force applied by the floats 26, 27, the grab 2 remains closed.

To release the vehicle, the system 1 can be lowered to a depth at which the opening force exerted by the floats 26, 27 is sufficient to open the grab 2 spontaneously.

It is also possible to use vertical motors on the vehicle 30 to move it upwards and relieve the grab 2 of the weight of the vehicle 30. This will reduce the force acting on the sling 6 and the grab 2 can then be opened by the action of the floats 26, 27.

Vertical and horizontal motors on the submersible vehicle 30 can then be used to release the handling feature 34 by raising and reversing the vehicle 30 rearwards to get it over the protuberances 23. Once the submersible vehicle 30 is free, it can be moved about freely. During the mission of the vehicle 30, the system 1 can be left in the water or hoisted back onto the platform if necessary.

To adjust the depth at which the grab will open, for example if it is wished to release the vehicle at a certain depth of water, the buoyancy of the floats can be varied, for example by ballasting the floats, notably by filling them with sea water.

The invention provides an underwater vehicle launch and recovery system capable of gripping an underwater vehicle without damaging it because the grab is capable of gripping the underwater vehicle through a dedicated handling feature present on the vehicle, preferably on the top of the underwater vehicle. The risk of collision between the system and the external equipment of the submersible vehicle is lessened.

The launch and recovery system can be employed with ease because the grab of the launch and recovery system is closed simply by suspending the launch and recovery system, and opened simply by lowering the launch and recovery system into the water.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description to the invention. Changes may be made in the elements described herein without departing from the spirit and scope of the invention as described in the following claims. In addition, it is to be understood that features described herein independently may, in certain embodiments, be combined.

What is claimed is:

1. Submersible vehicle launch and recovery system comprising a grab comprising at least two arms capable of moving relative to each other, the arms being rotatable between an open position and a closed position, in which closed position the jaws of the arms are able to grip a handling element on a submersible vehicle, the arms comprising attachment means so arranged that the arms tend to close when the system is suspended by the said attachment means, at least one arm comprising buoyancy means so distributed as to tend to open the said arm when the system is submerged.

2. System according to claim 1, wherein the arms are arranged in a cross and connected rotatably about a hinge pin at the intersection of the arms.

3. System according to claim 2, wherein each arm comprises, at a first end situated on one side of the hinge pin, a jaw and a buoyancy means, and, at a second end situated on the other side, arm attachment means.

4. System according to claim 1, wherein a buoyancy means is provided in the form of a hollow float equipped with fluid filling and evacuation means, wherein the fluid is air and/or water.

5. System according to claim 1, wherein the arms are provided with guide means for acting on a handling feature provided on a submersible vehicle.

6. System according to claim 5, wherein the guide means comprises a V guide converging on a space situated between the jaws of the arms.

7. System according to claim 5, wherein the guide means comprises at least one end stop located on an arm designed to horizontally arrest a handling element situated on a submersible vehicle.

8. System according to claim 7, wherein the end stops are provided with protuberances arranged so as to prevent a reverse movement of a handling element once the latter is engaged against the end stops.

9. System according to claim 1, wherein the system comprises means for limiting the opening of the grab formed by the arms.

10. Submersible vehicle launch and recovery system comprising a grab comprising at least two arms capable of moving relative to each other, the arms being rotatable between an open position and a closed position, in which closed position the jaws of the arms are able to grip a handling element on a submersible vehicle, the arms being supported so that the arms tend to close when the system is suspended, at least one arm comprising a buoy so configured as to tend to open the said arm when the system is submerged.

11. Assembly comprising a launch and recovery system comprising a grab comprising at least two arms capable of moving relative to each other, the arms being rotatable between an open position and a closed position, in which closed position the jaws of the arms are able to grip a handling element on a submersible vehicle, the arms comprising attachment means so arranged that the arms tend to close when the system is suspended by the said attachment means, at least one arm comprising buoyancy means so configures as to tend to open the said arm when the system is submerged and a handling element designed to be attached to a submersible vehicle and configured so as to engage with the jaws of the launch and recovery system.

12. Assembly according to claim 11, wherein the handling element comprises a T-shaped profile having a web designed to be gripped by the jaws and a transverse bar for vertical support.

* * * * *